United States Patent [19]

Hamilton

[11] 3,950,009

[45] Apr. 13, 1976

[54] PYROTECHNIC FORMULATION

[75] Inventor: Brian K. Hamilton, Utica, Mich.

[73] Assignee: Allied Chemical Corporation, New York, N.Y.

[22] Filed: Aug. 10, 1973

[21] Appl. No.: 387,406

Related U.S. Application Data

[63] Continuation of Ser. No. 224,524, Feb. 8, 1972, abandoned.

[52] U.S. Cl. ..... 280/150 AB; 149/82; 102/39; 60/219

[51] Int. Cl.[2] ..... C06D 5/00

[58] Field of Search ..... 149/82; 280/150 AB; 60/219; 102/39

[56] References Cited

UNITED STATES PATENTS 3,647,393 3/1972 Leising et al. ..... 102/39 X

*Primary Examiner*—Stephen J. Lechert, Jr.

*Attorney, Agent, or Firm*—Jonathan Plaut; Ernest D. Buff

[57] ABSTRACT

A chemical gas generant mixture of carbon, an oxidizer which does not contain hydrogen and, optionally, a carbonate or other coolant.

6 Claims, 1 Drawing Figure

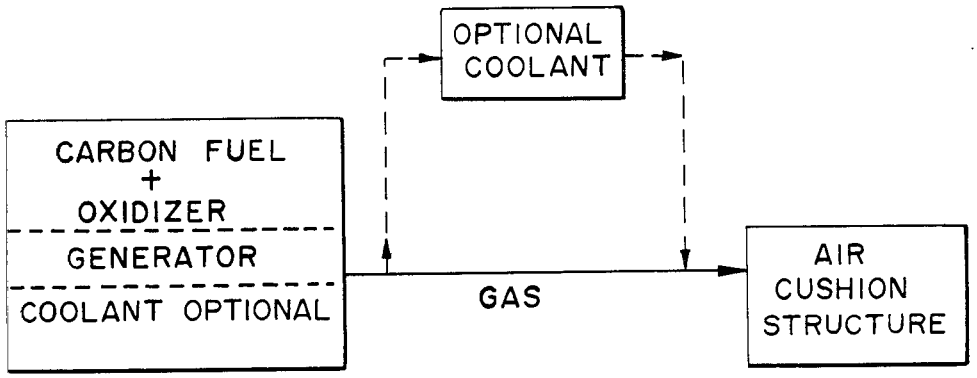
OPTIONAL
COOLANT
CARBON FUEL
+
OXIDIZER
GENERATOR
COOLANT OPTIONAL
GAS
AIR
CUSHION
STRUCTURE

PYROTECHNIC FORMULATION

This is a continuation of application Ser. No. 224,524, filed Feb. 8, 1972, now abandoned.

BACKGROUND OF THE INVENTION

Automobile safety has indicated the use of air cushion systems for passenger restraint. Much research and development has recently been carried out in the development of such air cushion systems both for the protection of passengers, as disclosed for example in U.S. patent application Ser. No. 81,947, filed Oct. 19, 1970, now U.S. Pat. No. 3,874,059 and for the protection of the driver, as for example in U.S. patent application Ser. No. 147,913, filed May 28, 1970 now U.S. Pat. No. 3,787,074. In both the case of the protection of the passenger and the driver, the gas used to fill the protective cushion or bag may be in part or all generated gas from a combustible material.

It is necessary that the generated gas withstand storage from about −40°F. to +220°F., will ignite rapidly, for example within just a few milliseconds, to be totally ignited and producing gas, and produce non-toxic gas at a relatively low temperature (less than about 2000°F.) when burned at pressures from 100 to 20,000 lbs/in$^2$. One problem with current combustible mixtures is that copious quantities of water vapor are produced as a product of combustion, since the fuels used are composed of carbon, hydrogen and oxygen components. The water vapor condenses on the inflated structure (the air cushion or bag), carrying considerable heat with it, which raises the temperature of the inflated structure to undesirable levels. This is particularly true if the inflated structure is porous, which is typical of at least a part of most air cushions utilized.

BRIEF SUMMARY OF INVENTION

Therefore, according to this invention, a combustible mixture of carbon, an oxidizer which does not contain hydrogen and, optionally, a coolant are mixed to form a combustible material which produces non-toxic gas rapidly, at relatively low temperature, and without the production of water vapor.

In a specific embodiment, the combustible mixture is formed of a relatively pure carbon product, such as "carbon black" or powdered graphite, an oxidizer not containing hydrogen, such as a metal chlorate or perchlorate, or a combination of the two, and, optionally, a carbonate to absorb heat by its decomposition.

DESCRIPTION OF THE INVENTION

In the preferred embodiment of this invention, the combustible mixture is made up of a carbon bearing material from a relatively pure carbon source (i.e. a carbon source having less than 5 mol % hydrogen). Specific examples of such carbon material are carbon black or powdered graphite. In the preferred embodiment of the invention, the carbon is combined in a mixture with an oxidizer which does not contain hydrogen, particularly any metal chlorate and/or perchlorate, such as potassium perchlorate ($KClO_4$) and/or potassium chlorate ($KClO_3$).

The combustible mixture can be used as a loose powder or mechanically compacted, as by a ram or press, or fused, as by wetting the mixture and drying it in place or by means of the addition of a known binder not specifically altering the mixture so as to produce significant quantities of water vapor.

The mixture described is over-oxidized when burned to such an extent that a negligible concentration of CO is produced. The excess oxidizer cools the reaction either by itself or in combination with a coolant which may optionally be added to the mixture before burning, or through which the generated gas from the combustion may be passed. The coolant is preferably a carbonate, such as magnesium carbonate and/or sodium carbonate which will absorb heat as a result of decomposition. Additional cooling of the generated gas may be obtained by passing said gas through a porous bed of a heat-absorbing material or loosely arranged metal or other mechanical cooling medium, such as chain, wire or porous sintered metal.

As shown in the drawing, which is a schematic of a process according to the invention, generated gas is passed to an air cushion structure from the generator and, optionally, cooled either by coolant in the combustible mixture or separately. In one specific example, 6 grams of lamp black were mixed with 140 grams of potassium perchlorate. The gas produced was at a temperature of about 1600°F. and then was directed through 320 grams of steel chain and filled a nylon porous air cushion of about 4 cubic feet, when inflated. The inflated bag remained cool to the touch of a human hand after filling. Of course, the addition of a chemical coolant, such as a carbonate which will absorb heat on decomposition as a result of its mixture to the combustible mixture itself or as a result of its contact with the generated gas after combustion further markedly lowers the temperature of the generated gas.

It is understood that the above-described example and general descriptive matter is merely illustrative of the invention and not meant to limit said invention, except as such invention is within the scope of the following claims.

I claim:

1. A method of supplying generated gas to expand an inflatable safety restraint without the production of substantial water vapor during gas generation, comprising the steps of:

a. preparing a mixture consisting essentially of:
   1. an oxidizer which does not contain hydrogen, said oxidizer being selected from the group consisting of metal chlorates and perchlorates;
   2. a carbon material;
   3. a carbonate coolant;

b. burning said mixture to produce a gas; and c. directing the gas into the inflatable safety restraint.

2. A method as recited in claim 1, further comprising compacting the unburned mixture of oxidizer, carbon material, and carbonate coolant with a binder.

3. A method as recited in claim 1, further comprising additionally cooling the produced gas after burning said mixture.

4. A method of supplying generated gas to expand an inflatable safety restraint without the production of substantial water vapor during gas generation, comprising the steps of:

a. preparing a mixture consisting essentially of:
   1. an oxidizer which does not contain hydrogen, said oxidizer being selected from the group consisting of metal chlorates and perchlorates;
   2. a carbon material;

b. burning said mixture to produce a gas; and c. directing the gas into the inflatable safety restraint.

5. A method as recited in claim 4, including the step of compacting the unburned mixture of oxidizer and carbon material with a binder.

6. A method as recited in claim 4, including the step of cooling the produced gas after burning said mixture.

* * * * *